US006423671B1

(12) United States Patent
Haruna

(10) Patent No.: US 6,423,671 B1
(45) **Date of Patent: *Jul. 23, 2002**

(54) LUBRICATING OIL COMPOSITIONS CONTAINING ORGANO MOLYBDENUM COMPOSITION

(75) Inventor: Junsuke Haruna, Tokai (JP)

(73) Assignee: The Lubrizol Corporation, Wickliffe, OH (US)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/167,266

(22) Filed: Oct. 6, 1998

Related U.S. Application Data

(63) Continuation-in-part of application No. 08/891,431, filed on Jul. 14, 1997, now abandoned.

(51) Int. Cl.[7] ..... C10M 133/18; C10M 133/56; C10M 135/18; C10M 137/10; C10M 139/00

(52) U.S. Cl. ..... 508/365; 508/363; 508/364; 508/369; 508/542

(58) Field of Search ..... 508/363, 365, 508/542, 369, 364

(56) References Cited

U.S. PATENT DOCUMENTS 4,529,526 A * 7/1985 Inoue et al. ..... 508/365
5,641,731 A * 6/1997 Baumgart ..... 508/181
5,744,430 A * 4/1998 Inoue et al. ..... 508/295

* cited by examiner

*Primary Examiner*—Cephia D. Toomer
(74) *Attorney, Agent, or Firm*—Teresan W. Gilbert; Michael F. Esposito

(57) ABSTRACT

Organo molybdenum containing oils of lubricating viscosity having improved high temperature frictional properties are made using semi-packages of additives. The semi-packages contain: (A) a dispersant, a zinc salt, and a detergent and (B) an organo molybdenum compound. The packages are formed individually prior to mixing.

8 Claims, 4 Drawing Sheets

Effect of Mo-DTC and ZDTP on μ

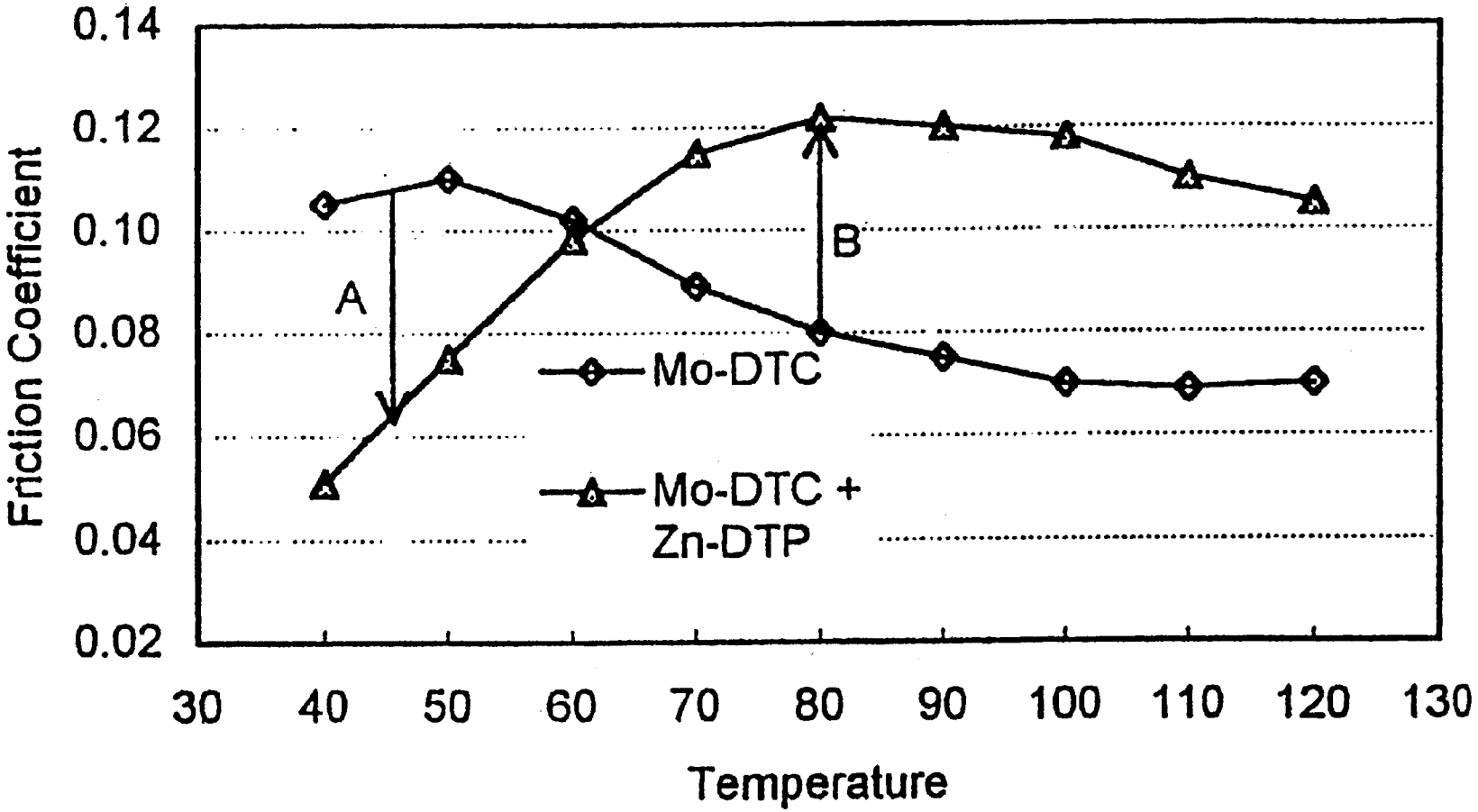
Fig.1 Effect of Mo-DTC and ZDTP on μ

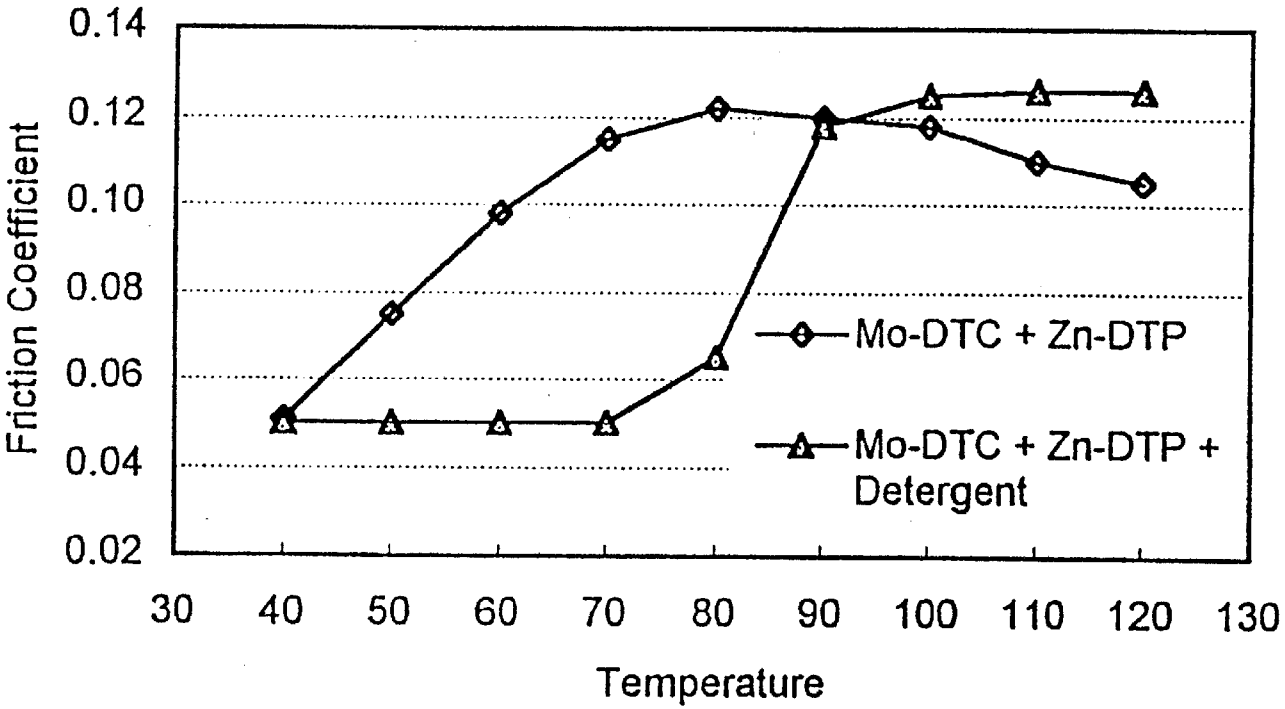
Fig.1 Effect of Mo-DTC and ZDTP on μ
Fig.2 Effect of Detergent on μ

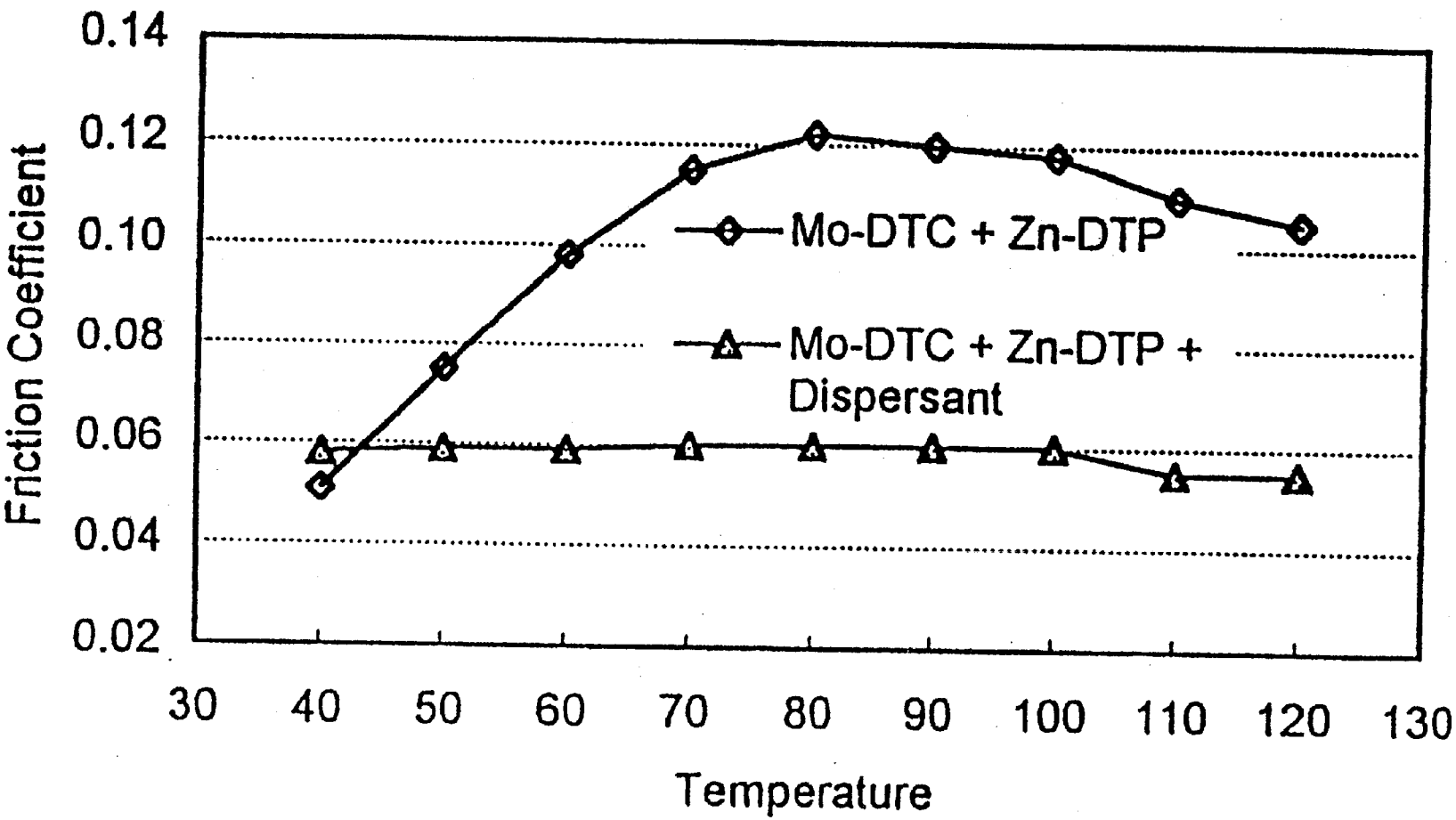
Fig.3 Effect of Dispersant on μ

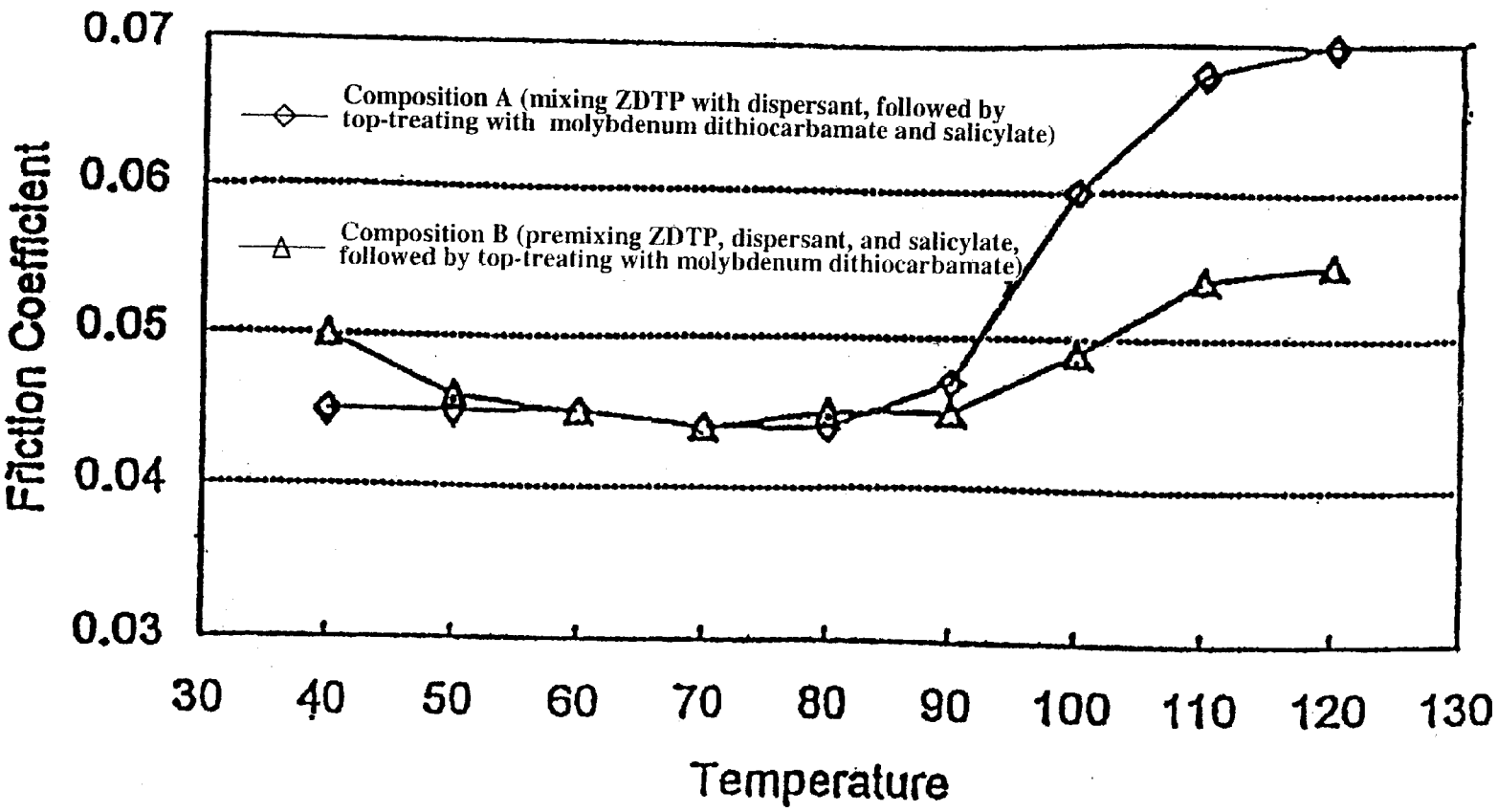
Fig.4 Effect of Premixing Polar Components with Dispersants on μ

LUBRICATING OIL COMPOSITIONS CONTAINING ORGANO MOLYBDENUM COMPOSITION

This is a Continuation-in-part of application(s) Ser. No. 08/891,431, filed on Jul. 14, 1997 now abandoned,.

FIELD OF INVENTION

The present invention relates to novel lubricating compositions and methods of preparing the compositions. The compositions comprise organo molybdenum compounds in an oil of lubricating viscosity. The compositions have improved high temperature frictional characteristics which translates into improved fuel economy when said compositions are used in an internal combustion engine.

BACKGROUND OF THE INVENTION

It is known that organo molybdenum compounds can improve frictional characteristics of lubricating compositions. For instance PCT Patent Application WO 96/23856 by the Tonen Corporation discloses that molybdenum dithiocarbamate and molybdenum dithiophosphate improve the frictional characteristics of lubricating oil used in an internal combustion engine. The lubricating oil contributes to improved fuel economy by virtue of its reduced frictional properties.

PCT Patent Application WO 96/06904 by the same Japanese corporation discloses the use of an oxymolybdenum dithiocarbamate sulfide as an organo molybdenum friction reducer for use in lubricating oils for internal combustion engines. Both patent applications referenced above are incorporated herein by reference in their entirety and in particular for their disclosure of organo molybdenum compounds.

SUMMARY OF THE INVENTION

This invention comprises oils of lubricating viscosity compositions containing organo molybdenum compounds and methods of making said oils. The oils have reduced frictional characteristics which translates into improved fuel economy for internal combustion engines lubricated by said oils.

We have found that lubricating oil compositions which contain organo molybdenum compounds show improved frictional characteristics when said compositions are formed from separate semi-packages of additive components. In this we have found that improved friction characteristics result when the semi-package compositions comprise:

- Semi-package 1: organo molybdenum compound and non-polar additives;
- Semi-package 2: dispersant plus polar additives selected from the group consisting of metal-containing detergents, zinc salts, surfactants and mixtures thereof;
- Semi-package 2 is mixed and heated for 0.25–6 hours at up to 110° C. prior to use.

The semi-packages are then added to an oil of lubricating viscosity to form an oil composition having improved frictional characteristics.

It is known that friction modifiers which increase the lubricity of lubricating oils may operate by the absorption of polar components on the moving parts to be lubricated. Polar components may be metal-containing compositions such as detergents, zinc salts, and -surface active agents. Such absorption reduces the energy needed to move one part relative to another and thus reduce the coefficient of friction for the oil. We have discovered that the coefficient of friction of lubricating composition is effected by competition for absorption of polar components on said relatively moving parts.

Thus we have found that the tendency for absorption or various polar compounds relative to molybdenum dithiocarbamate is:

- Zinc dialkydithiophosphate>molybdenum dithiocarbamate
- Calcium sulfonate detergents>molybdenum dithiocarbamate
- Surfactant>molybdenum dithiocarbamate The conclusion above was reached by determining friction coefficients of oils of lubricating viscosity containing the additives listed. What the results mean is that in lubricant compositions containing organo molybdenum compounds together with zinc salts, metal-containing detergents and surfactants will not result in properties demonstrating the full lubricity improvement from the molybdenum compounds because of preferred absorption on moving surfaces of the non-molybdenum polar components.

We have found that the competitive effect of selective absorption by various components on surfaces to be lubricated can be reduced by the use of dispersants in the formation of selective separate additive semi-packages and the addition of said additive semi-packages to said oil.

Thus we have discovered that when the polar components shown above are first mixed and heated with a dispersant, then the tendency of absorption on surfaces to be lubricated is reversed from that shown above and molybdenum is at least about equally if not preferentially absorbed. This is illustrated as:

- dispersant plus zinc dialkydithiophosphate<molybdenum dithiocarbamate dispersant plus calcium sulfonate detergent<molybdenum dithiocarbamate dispersant plus surfactant<molybdenum dithiocarbamate

DETAILED DESCRIPTION OF THE INVENTION

To demonstrate this invention, several individual components as well as mixtures of components were added to an oil of lubricating viscosity and friction coefficients were determined. As a starting point the friction coefficient of molybdenum dithiocarbamate was determined in a 100 neutral oil containing 1.2 weight percent of the molybdenum compound. The molybdenum dithiocarbamate is available as Adeka S-100 from Asahi Denka Kogyo K. K., Tokyo 103 Japan, and may also be purchased from the R. T. Vanderbilt company of Norwalk, Conn., U.S.A. FIG. 1 illustrates that the molybdenum compound reduces friction with time and temperature increase.

The organo molybdenum compounds which may be used in this invention are those listed above in WO 96/23856 and WO 96/06904 and those purchased from commercial sources such as R. T. Vanderbilt and Asahi Denka Kogyo K. K. listed above.

The Vanderbilt organo molybdenum compounds are MOLYVAN® A, a molybdenum oxysulfide dithiocarbamate; MOLYVAN® L, a sulfurized oxmolybdenum organophos-phorodithioate; MOLYVAN® 807, a molybdenum-sulfur compound; MOLYVAN® 822, an organo molybdenum dithiocarbamate; MOLYVAN® 855, an organo molybdenum complex and MOLYVANO 856 B, an organo molybdenum complex. Purchased organo molybdenum compounds are used as purchased. The organo molybdenum compounds also include those disclosed in U.S. Pat. No. 4,846,983 which is incorporated herein by reference for such disclosure. These are molybdenum carbamate compounds.

BRIEF DESCRIPTION OF DRAWINGS

FIG. 1 also shows the result when 0.91 weight percent of zinc dialkydithiophosphate (DTP) is added to the 1.2 weight percent molybdenum in 100 neutral oil composition. The results in FIG. 1 demonstrates that the zinc salt lowers the effectiveness of the organo molybdenum friction-reducing capabilities over time and at higher temperatures, but that the zinc salt addition lowers the oils friction coefficient at lower temperatures. Thus the Zn DTP salt lowers the effectiveness of molybdenum organic compounds at higher temperatures.

FIG. 2 demonstrates the effects on friction coefficient when a metal-containing detergent is added to the molybdenum/zinc-containing oil referenced above. In this, 1.8 weight percent of an overbased calcium sulfonate having 52% oil content and a TBN of 300 was added to the molybdenum/zinc oil discussed in FIG. 1. FIG. 2 shows that a metallic detergent decreases the coefficient of friction of the oil at lower temperatures, but with time and temperature the coefficient of friction increases.

FIG. 3 demonstrates that a dispersant being added to the 100 neutral oil containing the molybdenum/zinc additives as described above reduces the friction of coefficient of the oil at both high and low temperatures.

The results demonstrated in FIGS. 1–3 discussed above suggest that polar components in oil such as zinc dialkydithiophosphate and metal-containing detergents prevent organo molybdenum compounds from lowering friction coefficients of oils containing the zinc salts and metal-containing detergents at high temperature. The results also demonstrate that dispersants are effective at both high and low temperatures in reducing the friction coefficient of oils containing organo molybdenum compounds and polar compounds such as metal-containing detergents, and zinc salts together with the dispersants.

To ensure that the effect of dispersants in lowering the competitive absorption of metal-containing detergents, and zinc salts as well as surface active agents it was found that the various components should be mixed in semi-packages, then the packages added to the oil to effect an oil of lubricating viscosity composition having improved coefficient of friction properties.

To demonstrate this effect, two different oils of lubricating viscosity based on 5W-20 oil were formulated. The composition of the two oil formulations are given below where each uses a 5W-20 viscosity base oil. The first oil composition A is comprised of said multigrade base oil containing 2.82 weight percent on a chemical basis of a $\overline{M}$n 2000 polyisobutkylene substituted succininide and 0.91 weight percent on a chemical basis of zinc dial dithiophosphate. Oil A is then top-treated with 1.2 weight percent molybdenum dithiocarbamate (Adeka S-100) and 2.2 weight percent calcium salicylate detergent (Shell AC-60). The latter two components are used as purchased without consideration for oil content.

The second oil composition B comprises the same base oil as A as well as the same amounts of dispersants and zinc salts as used in oil A. To the oil is further added 2.2 weight percent of calcium salicylate detergent (Shell AC-60). This oil containing the dispersant, zinc salt and detergent is then top treated with 1.2 weight percent of molybdenum dithiocarbamate (Adeka S-100). The coefficient of frictions of oils A and B versus temperature is shown in FIG. 4. This graph illustrates that by premixing the dispersant with the polar components represented by zinc salts and detergents, the dispersant is able to negate the selective absorption of the metal ions from the polar compounds onto the surfaces to be lubricated which absorption limits the absorption of molybdenum. Thus by using a dispersant to in effect tie up the metal portions of the polar components, molybdenum is thus allowed to be selectively absorbed and the benefits of the lubricity of organo molybdenum compounds is more fully realized.

In a preferred embodiment of this invention, the following semi-packages are made and then added to an oil of lubricating viscosity.

Semi-package A:

(1) 3.05 weight percent on a chemical basis of $\overline{M}$n 2000 polyisobutenyl succinimide;

(2) 0.47 weight percent of a calcium overbased sulfonate detergent of TBN 300; which contains 2.5 weight percent of a phenol/formaldehyde reaction product;

(3) 0.91 weight percent on a chemical basis of a zinc O, O-di(1-methylethyl 1,3 dimethylbutyl)dithiophosphate;

(4) 0.6 weight percent calcium dodecylphenate sulfide;

(5) 0.2 weight percent nonylphenoxypoly(ethylene oxy) ethanol.

Semi-package A is heated at about 90° C. for about 1–3 hours prior to use. The heating should be at less than about 110° C. for about 0.5–5 hours.

Semi-package B 1.2 weight percent Adeka S- 100 molybdenum dithiocarbamate 1.0 weight percent dodecylphenol, 1–6 ditetraybutyl The ranges for weight percent of components on a chemical basis or as purchased is given below for the semi-packages of the invention, and corresponds to levels which when added to an oil of lubricating viscosity would be present in an effective amount in such oils. The range of use in Semi-package A: the dispersant is 0.05–20 weight percent, the metal-containing detergent is 0.05–10 weight percent, the zinc salt is 0.1–10 weight percent and the surface active agent is 0.05–10 weight percent.

The components present in Semi-package B are present as 0.01–10 weight percent for the organo molybdenum compounds and 0.1–10 weight percent for other compounds such as antioxidants.

In another embodiment of the present invention, a first semi-package comprising molybdenum dialkyl dithiocarbamate and a second semi-package comprising polyisobutenyl substituted succinimide dispersant; zinc dialkyldithiophosphate, and a metal-containing detergent, wherein the second semi-package is heated at less than about 110° C. for about 0.5–5 hours prior to use, is added to a majority of an oil of lubricating viscosity to form an oil composition. The oil of lubricating viscosity comprises 75–97.5 weight percent of the oil composition that is formed. The first semi-package comprises 0.5–5 weight percent of the oil composition that is formed. The second semi-package comprises 2–20 weight percent of the oil composition that is formed.

The oxymolybdenum compounds for use in this invention are those sold by the Vanderbilt Company and by Asahi Denka Kogyo K. K., both corporations referenced earlier above. The organo molybdenum compounds useful in the invention are also the molybdenum carbamate compounds disclosed in U.S. Pat. No. 4,846,983 by Wards; said patent is incorporated herein by reference. Also, the oxymolybdenum compounds may be those disclosed in patent applications WO 96/23856 and WO 96/06904. The preferred organo molybdenum compounds are molybdenum dithiocarbamate and molybdenum dithiophosphates.

This semi-package containing the organo molybdenum compound may also contain non-polar compounds such as antioxidants like phenols and aromatic-amines and the like; those familiar with the lubricating art will be well familiar with antioxidants useful in a semi-package with said molybdenum organics. Phosphorous compounds may be trialkyl phosphates, trialkyl phosphites.

In the semi-package containing the dispersant which is used to fix elements which can compete with molybdenum for absorption on surfaces to be lubricated, the dispersant may be any of those known to those skilled in the art. Dispersants includes those as described in U.S. Pat. No. 4,234,435 and post-treated dispersants disclosed therein. This patent is incorporated herein by reference in its entirety.

U.S. Pat. No. 4,234,435 describes dispersant which are formed by reacting a substituted carboxylic acylating agent with a reactant selected from the group consisting of (a) amine characterized by the presence within its structure of at least one H—N<group, (b) alcohol, (c) reactive metal or reactive metal compound, and (d) a combination of two or more of any of (a) through (c), the components of (d) being reacted with said one or more substituted succinic acylating agents simultaneously or sequentially in any order Ammonia and hydrazine are included as reactants herein. The preferred dispersants of this invention are formed by reacting ethylenepolyamines with substituted carboxylic acylating agents, said agents comprising $\overline{M}n$ 300–2500 polyisobutylene substituted succinic anhydrides. Monocarboxylic α-β unsaturated carboxylic compounds may also be substituted by polyisobutylene and then further reacted with the reactants listed above to form dispersants.

Acylated nitrogen compositions prepared by reacting the acylating reagents of this invention with amine as described above are post-treated by contacting the acylated nitrogen compositions thus formed (e.g., the carboxylic derivative compositions) with one or more post-treating reagents selected from the group consisting of boron oxide, boron oxide hydrate, boron halides, boron acids, esters of boron acids, carbon disulfide, sulfur, sulfur chlorides, alkenyl cyanides, carboxylic acid acylating agents, aldehydes, ketones, urea, thio-urea, guanidine, dicyanodiamide, hydrocarbyl phosphates, hydrocarbyl phosphites, hydrocarbyl thiophosphates, hydrocarbyl thiophosphites, phosphorus sulfides, phosphorus oxides, phosphoric acid, hydrocarbyl thiocyanates, hydrocarbyl isocyanates, hydrocarbyl isothiocyanates, epoxides, episulfides, formaldehyde or formaldehyde-producing compounds plus phenols, and sulfur plus phenols. The same post-treating reagents are used with carboxylic derivative compositions prepared from the acylating reagents of this invention and a combination of amines and alcohols as described above. However, when the carboxylic derivative compositions of this invention are derived from alcohols and the acylating reagents, that is, when they are acidic or neutral esters, the post-treating reagents are usually selected from the group consisting of boron oxide, boron oxide hydrate, boron halides, boron acids, esters of boron acids, sulfur, sulfur chlorides, phosphorus sulfides, phosphorus oxides, carboxylic acid acylating agents, epoxides, and episulfides.

Since post-treating processes involving the use of these post-treating reagents is known insofar as application to reaction products of high molecular weight carboxylic acid acylating agents of the prior art and amines and/or alcohols, detailed descriptions of these processes herein is unnecessary. In order to apply the prior art processes to the carboxylic derivative compositions of this invention, all that is necessary is that reaction conditions, ratio of reactants, and the like as described in the prior art, be applied to the novel carboxylic derivative compositions of this invention.

Also included in the dispersants of this invention in addition to those referenced above are in fact the same dispersants as those above in structure, but which are formed by various direct alkylation reactions between a high vinylidine polyolefin and an α-β unsaturated compound to form said substituted carboxylic acylating agent which is then further reacted to form a dispersant. The latter processes are described in U.S. Pat. No. 4,152,499 to BASF and European Patent Application 8,9202,032.2 to Shell.

Mannich dispersants are also of use in the semi-package which fixes constituents which may compete with molybdenum for surfaces active sites on moving parts in an internal combustion engine. Mannich dispersants are well known in the art; for a recent discussion, see U.S. Pat. No. 5,330,662 which is incorporated.

The compositions of the present invention may also include Mannich dispersants formed from at least one reaction product of a hydroxyaromatic compound, an aldehyde, and an amine. These reaction products are generally referred to as.Mannich reaction products. The reaction may occur from room temperature to 225° C., usually from 50° to about 200° C. (75° C.–150° C. most preferred), with the amounts of the reagents being such that the molar ratio of hydroxyaromatic compound to aldehyde to amine is in the range from about (1:1:1) to about (1:3:3).

The first reagent is a hydroxyaromatic compound. This term includes phenols (which are preferred), carbon-, oxygen-, sulfur- and nitrogen-bridged phenols and the like as well as phenols directly linked through covalent bonds (e.g. 4,4'-bis(hydroxy)biphenyl), hydroxy compounds derived from fused-ring hydrocarbon (e.g., naphthols and the like); and polyhydroxy compounds such as catechol, resorcinol and hydroquinone. Mixtures of one or more hydroxyaromatic compounds may be used as the first reagent.

In one embodiment, the hydroxyaromatic compounds are those substituted with at least one, and preferably not more than two, aliphatic or alicyclic groups having at least about 6 (usually at least about 30, or at least about 50) carbon atoms and up to about 400 carbon atoms, or to about 300, or to about 200. These groups may be derived from the above described polyalkenes. In one embodiment, the hydroxyaromatic compound is a phenol substituted with an aliphatic or alicyclic hydrocarbon-based group having an $\overline{M}n$ of about 420 to about 10,000.

In one embodiment, the hydroxyaromatic compounds are those of the formula

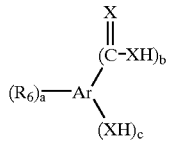

wherein $R_6$ is hydrogen or an aliphatic hydrocarbyl group preferably derived from the above-described polyalkenes, a is a number in the range of one to about four, usually one or two, Ar is an aromatic group, each X is independently sulfur or oxygen, preferably oxygen, b is a number in the range from zero to about four, usually one or two, c is a number in the range of one to about four, usually one to two, with the proviso that the sum of a, b and c does not exceed the number of valences of AR.

$R_6$ is hydrogen, or said hydrocarbyl group having from 1 to about 100 carbon atoms such as an alkyl having from 1 or about 7 to about 30, or to about 20 carbon atoms, an alkenyl group having about 2, or to about 8 to about 30 or to about 20 carbon atoms, a cycloalkyl group having from about 4, or to about 5, to about 10, or to about 7 carbon atoms, an aromatic group having from about 6 to about 30 carbon atoms, an aromatic-substituted alkyl group or alkyl-substituted aromatic group having a total of from about 7 to about 30, to about 12 carbon atoms. In one embodiment, the hydrocarbyl substituent is an alkyl group having from 7 to about 20, or to about 14 carbon atoms. In one embodiment, the R6-groups is a hydrocarbyl group that is directly bonded to the aromatic group Ar. Examples of R6 groups include substituents derived from any of the polyalkenes described above. Examples of useful polyalkenes include polyethylenes, polypropylenes, polyisobutylenes, ethylene-propylene copolymers, chlorinated olefin polymers and oxidized ethylene-propylene co-polymers.

Examples of suitable hydrocarbyl-substituted hydroxyaromatic compounds include the various naphthols, and more preferably the various alkyl-substituted catechols, resorcinols, and hydroquinones, the various xylenols, the various cresols, aminophenols, and the like. Examples of various suitable compounds include heptylphenol, octylphenol, nonylphenol, decylphenol, dodecylphenol, tetrapropy-phenol, eicosylphenol, and the like. Dodecylphenol, tetrapropylphenol and heptyl-phenol are especially preferred. Examples of suitable hydrocarbyl-substituted thiol-containing aromatics include heptylthiophenol, octylthiophenol, nonylthiophenol, dodecylthiophenol, tetrapropylthiophenol, and the like. Examples of suitable thiol- and hydroxyaromatic compounds include dodecylmonothio-resorcinol, 2-mercaptoalkyl-phenol where the alkyl group is as set forth above.

While the term "phenol" is used herein, it is to be understood that this term is not intended to limit the aromatic group of the phenol to benzene. Accordingly, it is to be understood that the aromatic group as represented by "Ar", as well as elsewhere in other formulae in this specification and in the appended claims, may be mononuclear or polynuclear. The polynuclear groups can be of the fused type wherein an aromatic nucleus is fused at two points to another nucleus such as found in naphthyl, anthranyl, etc. The polynuclear group can also be of the linked type wherein at least two nuclei (either mononuclear or polynuclear) are linked through bridging linkages to each other. These bridging linkages can be. chosen from the group consisting of alkylene linkages, ether linkages, keto linkages, sulfide linkages, polysulfide linkages of 2 to about 6 sulfur atoms, etc.

The number of aromatic nuclei, fused, linked or both, in Ar can play a role in determining the integer values of a and b. For example, when Ar contains a single aromatic nucleus, the sum of a and b is from 2 to 6. When Ar contains two aromatic nuclei, the sum of a and b is from 2 to 10. With a tri-nuclear Ar moiety, the sum of a and b is from 2 to 15. The value for the sum of a and b is limited by the fact that it cannot exceed the total number of displaceable hydrogens on the aromatic nucleus or nuclei of Ar.

The aromatic group Ar may have the same structure as any of the aromatic groups Ar discussed below. Examples of the aromatic groups that are useful herein include the polyvalent aromatic groups derived from benezene, naphthalene, anthracene, etc., preferably benzene. Specific examples of Ar groups include phenylenes and naphthylene, e.g., methylphenylenes, ethoxyphenylenes, isopropyl-phenylenes, hydroxy-phenylenes, dipropoxynaphylenes, etc.

Within this group of hydroxyaromatic compounds, a useful class of hydroxycarboxylic acids are those of the formula

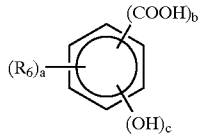

wherein $R_6$ is defined above, a is a number in the range of from one to about four, preferably one to about three; b is a number in the range of one to about four, preferably four to about two, c is a number in the range of zero to about four, preferably one to about two, and more preferably one; with the proviso that the sum of a, b and c does not exceed 6. in one embodiment, b and c are each one and the carboxylic acid is a salicylic acid.

The salicylic acids preferably are hydrocarbyl-substituted salicylic acids. The salicylic acids have the hydrocarbyl substituents derived from the above-described polyalkenes, particularly polymerized lower 1-mono-olefins such as polyethylene, polypropylene, polybutylene, ethylene/propylene copolymers and the like.

The above hydroxyaromatic compounds are well known or can be prepared according to procedures known in the art. Carboxylic acids of the type illustrated by these formulae are known and disclosed, for example, in U.S. Pat. Nos. 2,197,832; 2,197,835; 2,252,662; 2,252,664; 2,714,092; 3,410,798; and 3,595,791.

The second reagent is a hydrocarbon-based aldehyde, preferably a lower aliphatic aldehyde. Suitable aldehydes include formaldehyde, benzaldehyde, acetaldephyde, the butyraldehydes, hydroxybutyaldehydes and heptanals, as well as aldehyde precursors which react as aldehydes under the conditions of the reaction such as paraformaldehyde, paraldehyde, formalin and methal. Formaldehyde and its precursors and reaction synthons (e.g., paraformaldehyde, trioxane) are preferred. Mixtures of aldehydes may be used as the second reagent.

The third reagent is any amine described above. Preferably the amine is any polyamine as described above.

The reaction products of a hydrocarbyl-substituted hydroxyaromatic compounds, aldehydes, and amines are described in U.S. Pat. Nos. 3,980,569; 3,877,899; and 4,454,059, the disclosures of which are herein incorporated as reference.

In addition to hydrocarbyl-substituted succimide dispersants and Mannich dispersants, dispersants formed from various glyoxylic reactants and polyamines may also be included in the semi-package used to fix surface active agents and polar compounds. The glyoxylic-based compounds for use in forming dispersants are based on the reaction of glyoxylic compounds with olefins to form substituted acylating agents, which acylating agents can then be reacted with the same reactants as substituted succinic anlydride or acid acylating agents. The preferred glyoxylic reactants are glyoxylic acid and glyoxylic acid methyl ester m ethyl herniacital. These glyoxylic reactants are reacted with for instance a $\overline{M}n$ 300–5,000 polyisobutylene. to form a substituted acylating agent which then can be reacted with the reactants listed above for reactions of substituted carboxylic acylating agents. The reactants are ammonia, hydrazine, amines with one NH<group in their structures, alcohols, reactive metals and reactive metal compounds or mixtures thereof reacted in any sequence. The synthesis of various glyoxylic based acylating agents are described in European patent publications EP 0759443, EP 0759444 and EP 0759435 The corresponding U.S. patents of these European Patent Applications are 6,114,547; 5,777,142; 5,739,356, respectively which are incorporated herein by reference in their entirety.

The polar compounds for use in the semi-package containing the dispersant are selected from zinc salts and metal-containing detergents. The preferred zinc salt for use in motor oils for internal combustion engines are zinc dialkydithiophosphates, zinc dithiocarbamates and zinc oleate. These well known antiwear and extreme pressure agents are well known in the lubricant arts and are disclosed in U.S. Pat. No. 5,110,488 and Canadian Patent 1043322 and references included therein. The U.S. Pat. No. 5,110,488 is herein incorporated by reference.

Likewise, metal-containing detergents are extremely well known in the art. In general the detergents are alkylbenzene sulfonic acids, salicylates, carboxylates phosphonates, and phenates which have been neutralized or overbased with Li, Na, K, Ca, Mg, Mg, Ba, St and AP. A neutral detergent has a TBN of 30 or less while a "basic" detergent has a TBN typically of 200–500. Many detergents are commercially available and synthesis, characterization, and use of detergents abounds in the lubricant literature including patents. A discussion of detergents may be found in U.S. Pat. No. 4,792,410 which is incorporated herein by reference. Surfactants or surface active agents comprise another component of the dispersant containing semi-packages. What is meant by surfactants in the sense of this invention are compounds which may actively associate with a surface to be lubricated and thus compete with molybdenum for such associative effects.

Examples of surfactants are polyalkoxylated phenolics as described in U.S. Pat. No. 5,330,662 which is incorporated herein by reference. Other surfactants include oleic acid amide, glycerol monooleate and other compounds of this type which are disclosed in European Patent Application EP 0747464. The corresponding U.S. patent of this European Patent Application is 5,858,929 which is incorporated herein by reference. Such surface active agents, or friction modifier as they may be called, are fatty amines, fatty phosphites, metal salts of fatty acids, fatty acid amines, glycerol esters, alkoxylates fatty amines, and their counterpart borated derivatives as disclosed in EP 0747464.

Other compounds which may be included in the dispersant containing semi-package are extreme pressure agents which include alkyl and aryldisulfides and polysulfides chlorinated hydrocarbons, dialhylhydrogen phosphites and salts of alkyl phosphoric acids and dithiocarbamic acid derivatives. Sulfurized olefins are disclosed in Canadian Patent 1,280,404.

The semi-packages of this invention are added to an oil of lubricating viscosity.

Natural oils useful in making the inventive lubricants and functional fluids include animal oils and vegetable oils (e.g., lard oil, castor oil) as well as mineral lubricating oils such as liquid petroleum oils and solvent treated or acid-treated mineral lubricating oils of the paraffinic, naphthenic or mixed paraffinicnaphthenic types which may be further refined by hydrocracking and hydrofinishing processes and are dewaxed. Oils of lubricating viscosity derived from coal or shale are also useful. Synthetic lubricating oils include hydrocarbon oils and halo-substituted hydrocarbon oils such as polymerized and interpolymerized olefins (e.g., polybutylenes, polypropylenes, propylene-isobutylene copolymers, chlorinated polybutylenes, etc.); poly(1-hexenes), poly-(1-octenes), poly(1-decenes), etc. and mixtures thereof; alkyl-benzenes (e.g., dodecylbenzenes, tetradecylbenzenes, dinonylbenzenes, di-(2-ethylhexyl)-benzenes, etc.); polyphenyls (e.g., biphenyls, terphenyls, alkylated polyphenyls, etc.); alkylated diphenyl ethers and alkylated diphenyl sulfides and the derivatives, analogs and homologs thereof and the like.

Alkylene oxide polymers and interpolymers and derivatives thereof where the terminal hydroxyl groups have been modified by esterification, etherification, etc., constitute another class of known synthetic lubricating oils that can be used. These are exemplified by the oils prepared through polymerization of ethylene oxide or propylene oxide, the alkyl and aryl ethers of these polyoxyalkylene polymers (e.g., methyl-polyisopropylene glycol ether having an average molecular weight of about 1000, diphenyl ether of polyethylene glycol having a molecular weight of about 500–1000, diethyl ether of polypropylene glycol having a molecular weight of about 1000–1500, etc.) or mono- and polycarboxylic esters thereof, for example, the acetic acid esters, mixed $C_{3-8}$ fatty acid esters, or the $C_{13}$Oxo acid diester of tetraethylene glycol.

Another suitable class of synthetic lubricating oils that can be used comprises the esters of dicarboxylic acid (e.g., phthalic acid, succinic acid, alkyl succinic acids, alkenyl succinic acids, maleic acid, azelaic acid, suberic acid, sebacic acid, furmari acid, adipic acid, linoleic acid dimer, malonic acid, alkyl malonic acids, alkenyl malonic acids, etc.) with a variety of alcohols (e.g., butyl alcohol, hexyl alcohol, dodecyl alcohol, 2-ethylhexyl alcohol, ethylene glycol, diethylene glycol monoether, propylene glycol, etc.). Specific examples of these esters include dibutyl adipate, di(2-ethylhexyl) sebacate, di-n-hexyl fumarate, dioctyl sebacate, diisooctyl azelate, diisodecyl azelate, dioctyl phthalate, didecyl phthalate, dieicosyl sebacate, the 2-ethylhexyl diester of linoleic acid dimer, the complex ester formed by reacting one mole of sebacid acid with two moles of tetraethylene glycol and two moles of 2-ethylhexanoic acid and the like.

Esters useful as synthetic oils also include those made from C5 to C12 monocarboxylic acids and polyols and polyol ethers such as neopentyl glycol, trimethylol propane, pentaerythritol, dipentaerythritol, tripentaerythritol, etc.

Silicon-based oils such as the polyalkyl-, polyaryl-, polyalkoxy-, or polyaryloxy-siloxane oils and silicate oils comprise another useful class of synthetic lubricants (e.g., tetraethyl silicate, tetraisopropyl silicate, tetra-(2-ethlhexyl) silicate, tetra-(4-methyl-hexyisilicate, tetra-(p-tert-butylphenyl) silicate, hexyl-(4-methyl-2-pentoxy) disiloxane, poly(methyl) siloxanes, poly-(methylphenyl siloxanes, etc.). Other synthetic lubricating oils include liquid esters of phosphorus-containing acids (e.g., tricresyl phosphate, trioctyl phosphate, diethyl ester of decane phosphonic acid, etc.), polymeric tetrahydrofurans and the like.

Unrefined, refined and rerefined oils, either natural or synthetic (as well as mixtures of two or more of any of these) of the type disclosed hereinabove can be used in the lubricants of the present invention. Unrefined oils are those obtained directly from a natural or synthetic source without further purification treatment. For example, a shale oil obtained directly from retorting operations, a petroleum oil obtained directly from primary distillation or ester oil obtained directly from an esterification process and used without further treatment would be an unrefined oil. Refined oils are similar to the unrefined oils except they have been further treated in one or more purification steps to improve one or more properties. Many such purification techniques are known to those skilled in the art such as solvent extraction, secondary distillation, acid or base extraction, filtration, percolation, etc. Rerefined oils are obtained by processes similar to those used to obtain refined oils applied to refined oils which have been already used in service. Such rerefined oils are also known as reclaimed or reprocessed oils and often are additionally processed by techniques directed to removal of spent additives and oil breakdown products.

Experiments

Friction coefficients reported hereinabove were determined on an optimal instrument which uses a reciprocating steel cylinder on a stationary steel plate. The test involved a Tonen SRV test which evaluates friction/fuel economy performance of a motor. The test conditions used were:

Load: 400 newtons.

Frequency: 50 Hz

Stroke Length: 1.5 m

Temperature: Ramped from 40° C.–120° C.

Test Duration: 45 minutes

Oil Sample Size: 0.2 ml

The friction test results are shown in the figures included herein.

What is claimed is:

1. An oil composition having improved frictional characteristics, said composition consisting of:

(A) a majority of an oil of lubricating viscosity consisting of about 75 to about 97.5 weight percent of said oil composition;

(B) a semi-package consisting of a molybdenum containing organic compound and consisting of 0.5 to 5 weight percent of said oil composition;

(C) a semi-package consisting of an ashless dispersant selected from the group consisting of (1) reaction products of substituted carboxylic acylating agents with a reactant selected from the group consisting of (a) an amine characterized by the presence within its structure of at least one H—N<group, including ammonia and hydrazine, (b) an alcohol, (c) a reactive metal or metal compound, (d) a combination of two or more of any of (a) through (c), the components of (d) being reacted with one or more of said acylating substituted acylating agents simultaneously or sequentially in any order, and (2) Mannich dispersants; a polar compound selected from the group consisting of a metal-containing detergent, a zinc salt and a surface active agent and mixtures thereof; said semi-package consists of 2 to 20 weight percent of said oil composition; and the semi-package (C) being heated at less than about 110° C. for about 0.5 to 5 hours; wherein said oil composition is formed by mixing (A) through (C) in any order.

2. A composition according to claim 1, wherein said oil (A) is derived from plants, minerals or synthetic sources.

3. The composition according to claim 1, wherein said metal-containing detergent of semi-package (C) is selected from the group consisting of carboxylates, phenates, sulfonates, salicylates, and mixtures thereof.

4. The composition according to claim 1, wherein said metals of said metal-containing detergent of semi-package (C) is selected from the group consisting of Ca, Mg, Na, Li, Al, Ba and mixtures thereof.

5. The composition according to claim 1, wherein said zinc salt of semi-package (C) is selected from the group consisting of zinc dialklydithiophosphate and zinc dithiocarbamate.

6. The oil composition according to claim 1, wherein said molybdenum containing odrgaric compound of semi-package (B) is selected from the group consisting of (1) a molybdenum carbamate;

(2) a molybdenum dithiophosphate;

(3) a molybdenum oxysulfide dithiocarbamate;

(4) a sulfurized oxymolybdenum organophosphorodithioate;

(5) an organomolybdenum dithiocarbamate;

(6) an organomolybdenum complex; and (7) a molybdenum sulfur compound.

7. An oil composition having improved frictional characteristics, said composition consisting of:

(A) a majority of an oil of lubricating viscosity;

(B) a semi-package consisting of molybdenum dialkyldithiocarbamate; and (C)a semi-package consisting of polyisobutenyl substituted succinimide dispersant; zinc dialkydithiophosphate and a metal-containing detergent, wherein semi-package (C) is heated at less than about 110° C. for about 0.5–5 hours prior to use.

8. The composition according to claim 7, wherein said oil of lubricating viscosity (A) consists of 75–97.5 weight percent of said oil composition; semi-package (B) consists of 0.5–5 weight percent of said oil composition; and semi-package (C) consists of 2–20 weight percent of said oil composition.

* * * * *